US010873992B2

(12) United States Patent
Schlipf

(10) Patent No.: US 10,873,992 B2
(45) Date of Patent: Dec. 22, 2020

(54) HEATING CARTRIDGE WITH TEMPERATURE SENSOR

(71) Applicant: Tuerk & Hillinger GmbH, Tuttlingen (DE)

(72) Inventor: Andreas Schlipf, Tuttlingen (DE)

(73) Assignee: TUERK & HILLINGER GMBH, Tuttlingen (DE)

( * ) Notice: Subject to any disclaimer, the term of this patent is extended or adjusted under 35 U.S.C. 154(b) by 367 days.

(21) Appl. No.: 15/895,488

(22) Filed: Feb. 13, 2018

(65) Prior Publication Data

US 2018/0235029 A1 Aug. 16, 2018

(30) Foreign Application Priority Data

Feb. 15, 2017 (DE) ..... 20 2017 100 816 U

(51) Int. Cl.
*H05B 3/06* (2006.01)
*H05B 3/44* (2006.01)

(52) U.S. Cl.
CPC ..... *H05B 3/06* (2013.01); *H05B 3/44* (2013.01); *H05B 2203/014* (2013.01)

(58) Field of Classification Search
CPC ..... H05B 3/44; H05B 3/46; H05B 3/48
See application file for complete search history.

(56) References Cited

U.S. PATENT DOCUMENTS 4,300,038 A * 11/1981 Schwarzkopf ..... H05B 3/46 219/523
6,104,011 A 8/2000 Juliano
2006/0013282 A1 1/2006 Hanzawa et al.
2017/0071030 A1 3/2017 Schlipf

FOREIGN PATENT DOCUMENTS

CN 1721830 A 1/2006
DE 9201797 U1 4/1992
DE 19743774 A1 4/1999
DE 202015104723 U1 9/2015
EP 0660644 A2 6/1995

OTHER PUBLICATIONS

Search Report dated Oct. 26, 2017 in DE Application No. 20 2017 100 816.9.

* cited by examiner

*Primary Examiner* — Erin Deery
(74) *Attorney, Agent, or Firm* — Panitch Schwarze Belisario & Nadel LLP

(57) ABSTRACT

Heating cartridge with a tubular metal sheathing, whose interior houses an electrical heating element that is wound on a winding form and is electrically insulated from the tubular metal sheathing by embedding in an electrically non-conductive insulating material, and at least one temperature sensor with supply lines, wherein at least one supply line, preferably both supply lines, of at least one temperature sensor runs between the winding form and the tubular metal sheathing and is electrically insulated from the winding form and the heating element wound thereon and also from the tubular metal sheathing.

14 Claims, 4 Drawing Sheets

HEATING CARTRIDGE WITH TEMPERATURE SENSOR

CROSS-REFERENCE TO RELATED APPLICATIONS

This application claims priority under 35 U.S.C. § 119(b) to German Application No. 20 2017 100 816.9, filed Feb. 15, 2017, the disclosure of which is incorporated herein by reference in its entirety.

BACKGROUND OF THE INVENTION

The preferred invention relates to a heating cartridge with a temperature sensor with the characteristics of the preamble of claim 1.

For applications in which a guarantee of a certain provided heating power and/or heating temperature is important, heating cartridges are often used that are equipped with a temperature sensor or thermocouple. Based on the measurement data of this temperature sensor or this thermocouple, the electrical operating conditions, e.g., the operating current and/or the operating voltage, with which the heating cartridge is operated, are regulated. Below, the term "temperature sensor" is used in such a way that it also includes thermocouples.

In practice, the temperature ranges tolerated by users are becoming smaller and smaller, and the desired times until a temperature balance is reached are becoming shorter and shorter. This has the effect, on one hand, that the requirements on the precision of the temperature measurement increase and with this, on the other hand, the electrical operating conditions are subjected to more and more frequent changes. Here, it was determined in operations by the applicant in practice that with known heating cartridges, these two requirements negatively influence each other, because changing the operating conditions causes interference on the temperature signal and the interference of the temperature signal leads to increased changes to the operating conditions.

BRIEF SUMMARY OF THE INVENTION

The problem of the invention is therefore to disclose an improved heating cartridge with a temperature sensor, in which, in particular, this interaction between changes in the operating conditions and interference in the temperature signal is reduced.

This problem is solved by a heating cartridge with the characteristics of claim 1. Advantageous refinements of the invention are the subject matter of the dependent claims.

The heating cartridge according to the invention has a tubular metal sheathing, whose interior houses an electrical heating element—e.g., a heating wire—that is wound on a winding form and is electrically insulated from the tubular metal sheathing by embedding in an electrically non-conductive insulating material, and at least one temperature sensor with supply lines. Here it is explicitly noted that the conductor of a thermocouple is also to be understood as a supply line in the sense of this description. Furthermore, for the sake of orderliness, it is explicitly mentioned that a tubular metal sheathing can have a base but does not require one.

It is preferred for the invention that at least one supply line of at least one temperature sensor runs in the space between the winding form and the tubular metal sheathing (and not, as in the state of the art, inside of the winding form) and is electrically insulated from the winding form and the heating element wound thereon and also from the tubular metal sheathing.

The inventor has determined that this measure can significantly reduce the negative effect of changes to the operating conditions on the signals of the temperature sensor. The advantage is particularly large when all supply lines of the temperature sensors are guided in this way.

To produce a well-defined position of the supply lines relative to the metal sheathing, but also relative to the winding form and the heating element wound thereon, it is preferred that the winding form with the electrical heating element wound thereon and the supply line of the temperature sensor are held in recesses or holes of an insulating element.

It is especially preferred when the recesses or holes run parallel to the axis of the tubular metal sheathing, i.e., e.g., for cylindrical tubular metal sheathings parallel to the cylinder axis.

Preferably, the heating cartridge is compacted.

It is especially preferred when the insulating element is impregnated with a silicone-containing substance, e.g., silicone resin or silicone oil.

Ceramic molded bodies are especially well suited as insulating elements.

An even more reliable electrical insulation can be guaranteed if any remaining space between the wound winding form and the insulating element and between the tubular metal sheathing and the insulating element are filled at least partially with MgO granulate, which, in one preferred refinement, is also impregnated, especially by the incorporation of solid powdery silicone resin.

Compacting the heating cartridge at least in some sections contributes to even more elimination of any remaining empty space that might make good heat distribution difficult across the inner space of the heating cartridge and to the metal sheathing.

It is especially preferred when an electrical connection to connecting wires inserted into the recesses or holes is created in these recesses or holes in which the supply lines are arranged. In this way, the necessary connection is arranged at a position at which it is protected against mechanical loads by the heating cartridge. This connection can be produced, for example, by compacting, but it is even more advantageous when the molded body has windows that expose the supply lines and connecting wires at the positions at which the electrical connections are produced. The electrical connections can then be produced at these locations in a defined way, e.g., through welding, soldering, or optionally also crimping and with the possibility for visual checking.

If the heating cartridge is to have a very compact design, it is preferred when two supply lines of the same temperature sensor lie in a plane in which the winding form also lies and are arranged on different sides of the winding form.

In contrast, the arrangement of the winding form and supply lines within the metal sheathing is preferred when two temperature sensors are provided, such that the supply lines of one temperature sensor are outside a plane in which the winding form lies, and the supply lines of the other temperature sensor are below a plane in which the winding form lies.

It has proven advantageous when at least 3 connecting wires, which are here also to be understood to include terminal lines, are provided for contacting the supply lines of the temperature sensor and for contacting the electrical heating element, of which at least one runs through the winding form at least in some sections and of which at least two run outside of the winding form. In particular, preferably the connecting wires for contacting the electrical heating element run within the winding form and the connecting wires for contacting the supply lines of the temperature sensor run outside of the winding form.

It is further preferred when the connecting wires for contacting the supply lines of the temperature sensor and the supply lines of the temperature sensor are introduced from different sides into the insulating element. In this way, it can be avoided that the entire, possibly very long, connecting line must be threaded, e.g., through openings of an insulating element.

If the insulating element has openings or recesses for filling MgO powder or granulate, any empty spaces after inserting the insulating element can still be filled up and made electrically insulating during production.

It is further preferred when a press-fit contact is created between the connecting wires for contacting the supply lines of the temperature sensor and the supply lines of the temperature sensor and/or a press-fit contact is created between connecting wires for contacting the electrical heating element and the electrical heating element. This type of contact can be generated in a simple way by compacting the heating cartridge after the assembly.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1A:
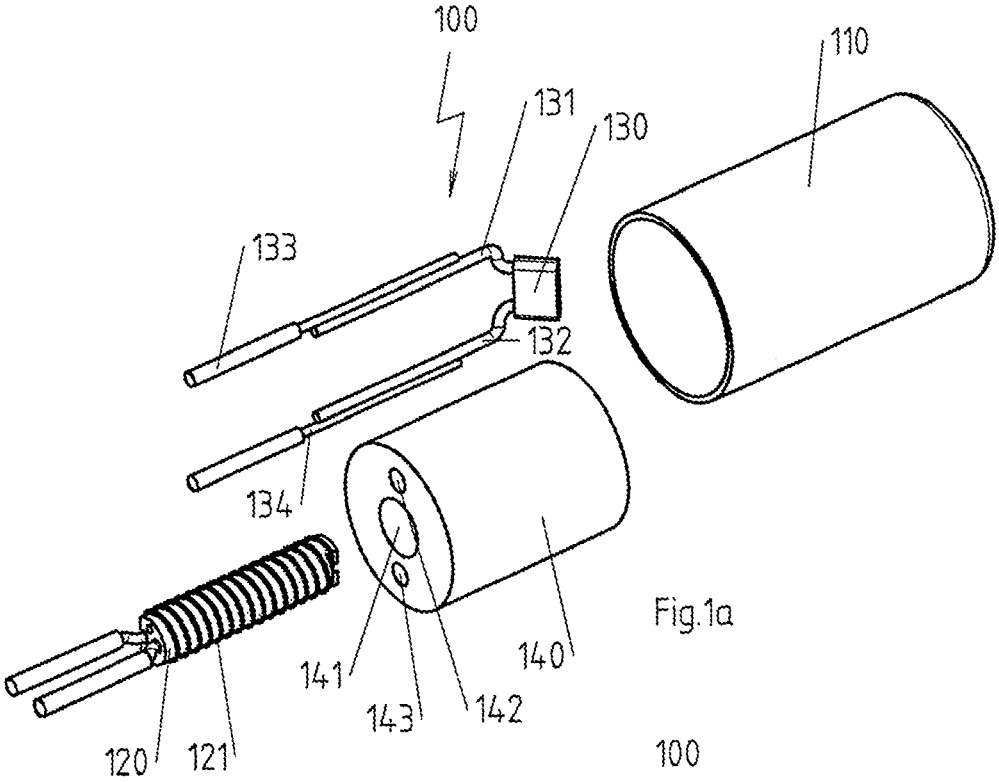
FIG. 1*a*: an exploded-view diagram of a first embodiment of a heating cartridge.
Figure 1B:
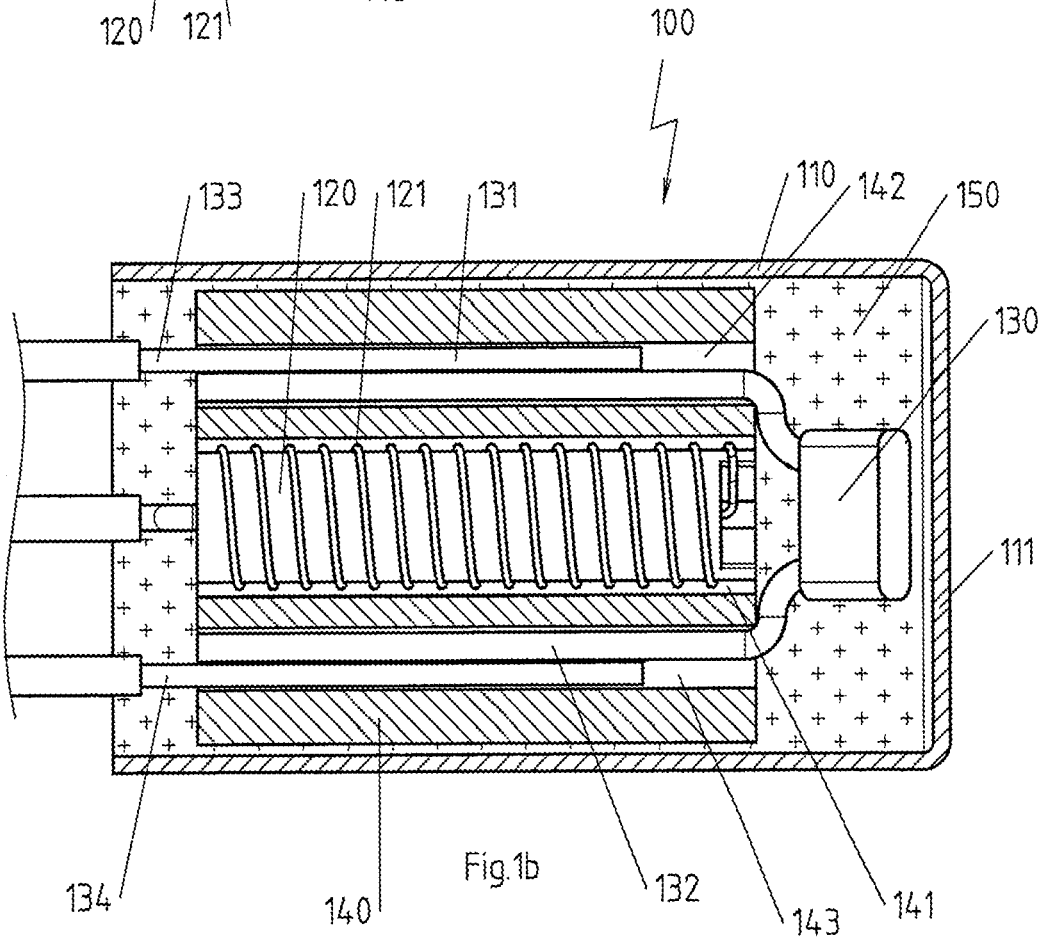
FIG. 1*b*: a section diagram of the embodiment from FIG. 1*a;*

FIG. 1*a* shows an embodiment of a heating cartridge 100 with tubular metal sheathing 110 with base 111 that can be seen in FIG. 1*b*, winding form 120 with heating element 121 wound thereon in the form of a heating wire, temperature sensor 130 with supply lines 131, 132 and connecting wires 133, 134, as well as an insulating element 140 with holes 141, 142, 143, which is constructed as a ceramic molded body.

As can be seen particularly well in FIG. 1*b*, the winding form 120 is held with a heating element wound thereon in a separate hole 141 of the insulating element 140 that is arranged here centrally in this hole, while the supply lines 131, 132 of the temperature sensor 130 that are contacted electrically to the connecting wires 133, 134 in a press-fit contact are guided in the holes 142, 143. Because these holes lie radially farther outside in the insulating element 140, the supply lines 131, 132 are also between the winding form and the tubular metal sheathing 110.

The remaining inside spaces of the tubular metal sheathing 110 are filled with Magnesium oxide ("MgO") granulate 150, 250, 350.

In particular, supply lines 131, 132 of the same temperature sensor, namely the temperature sensor 130, lie in a plane in which also the winding form 120 lies and are arranged on different sides of the winding form 120, namely in the representation of FIG. 1*b* one above the winding form 120 and one below the winding form 120.

Figure 2A:
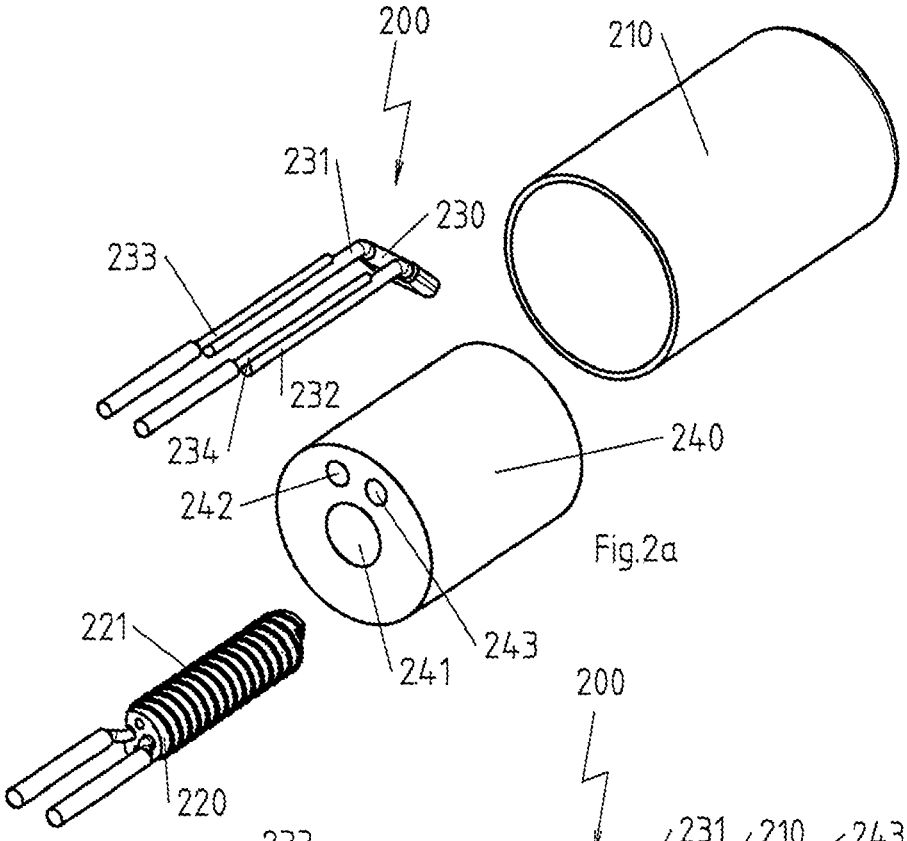
FIG. 2*a*: an exploded-view diagram of a second embodiment of a heating cartridge.
Figure 2B:
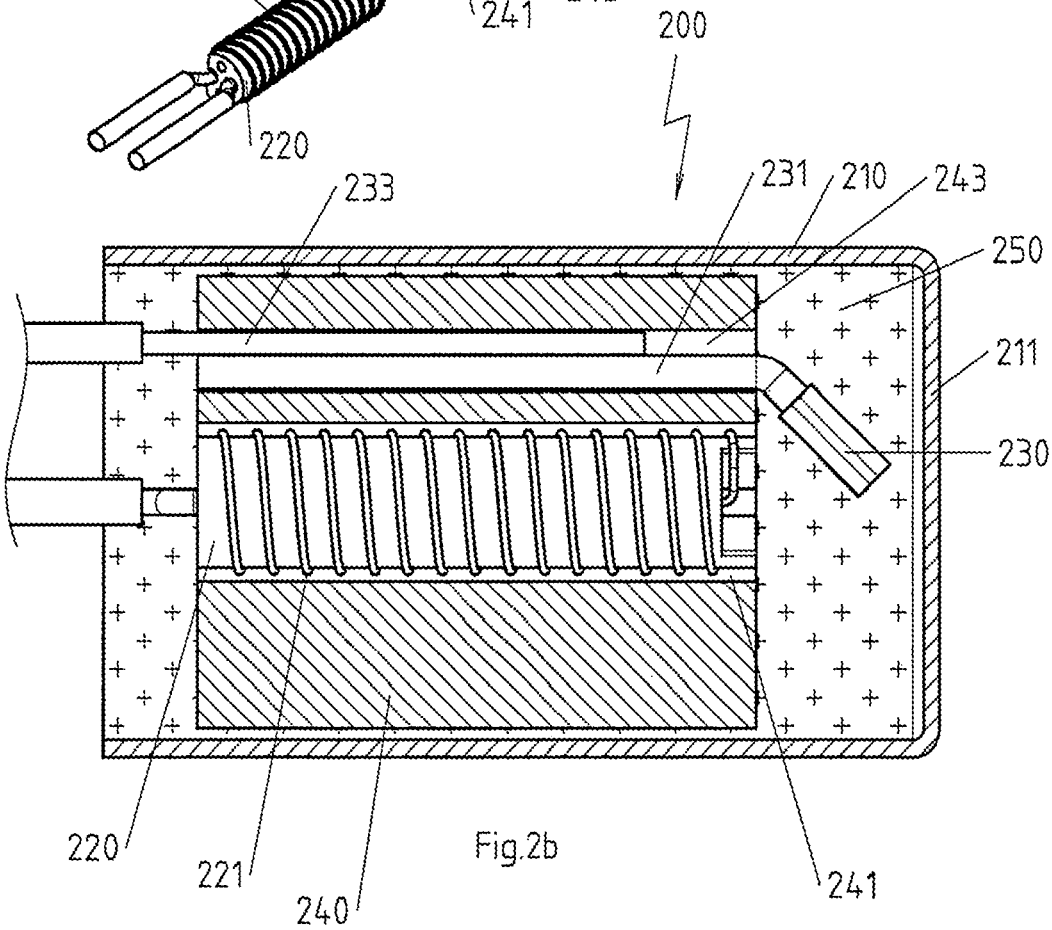
FIG. 2*b*: a section diagram of the embodiment from FIG. 2*a;*

The embodiment that is shown in FIGS. 2*a* and 2*b* is a heating cartridge 200 with tubular metal sheathing 210 with base 211 that can be seen in FIG. 2*b*, winding form 220 with heating element 221 wound thereon in the form of a heating wire, temperature sensor 230 with supply lines 231, 232 and connecting wires 233, 234, as well as an insulating element 240 with holes 241, 242, 243, which is constructed as a ceramic molded body.

The difference with respect to the embodiment of FIGS. 1*a* and 1*b* consists in the arrangement of the holes 242, 243, that here both lie above the central hole 241, in which the winding form 220 with heating element 221 wound thereon is inserted.

Figure 3A:
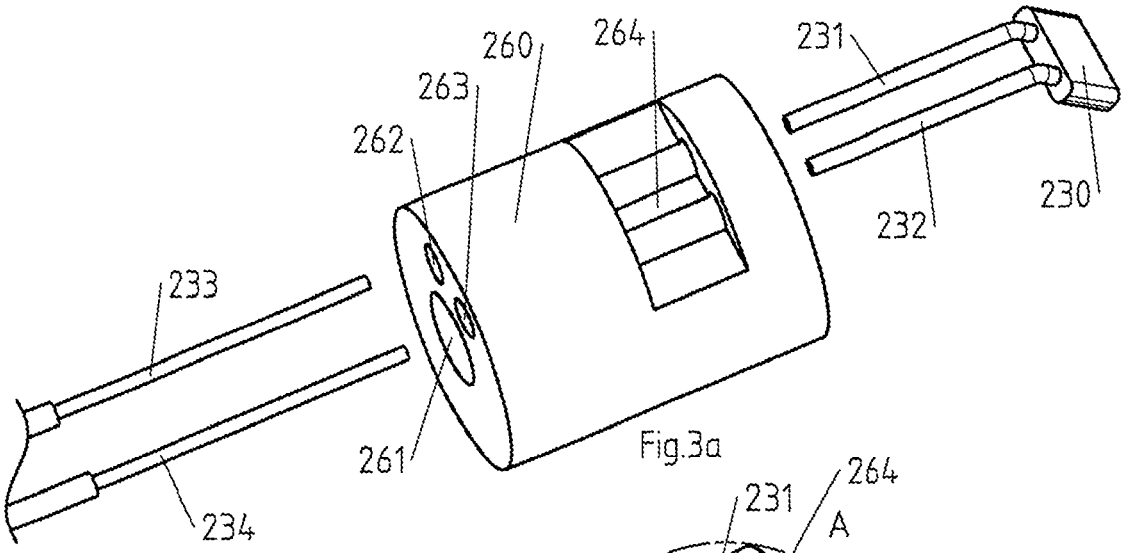
FIG. 3*a*: an exploded-view diagram of an inner structure of a variant of the second embodiment of FIG. 2*a;*
Figure 3B:
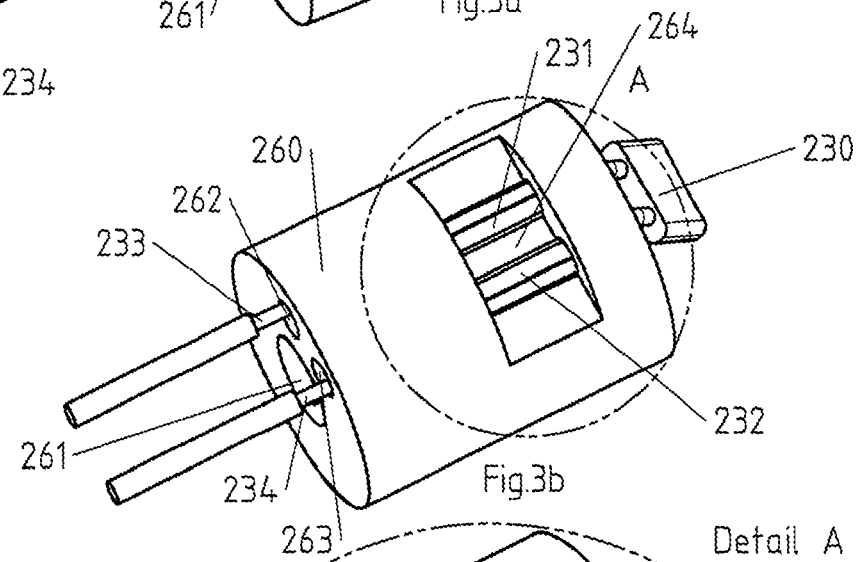
FIG. 3*b*: the inner structure from FIG. 3*a* in an assembled condition.
Figure 3C:
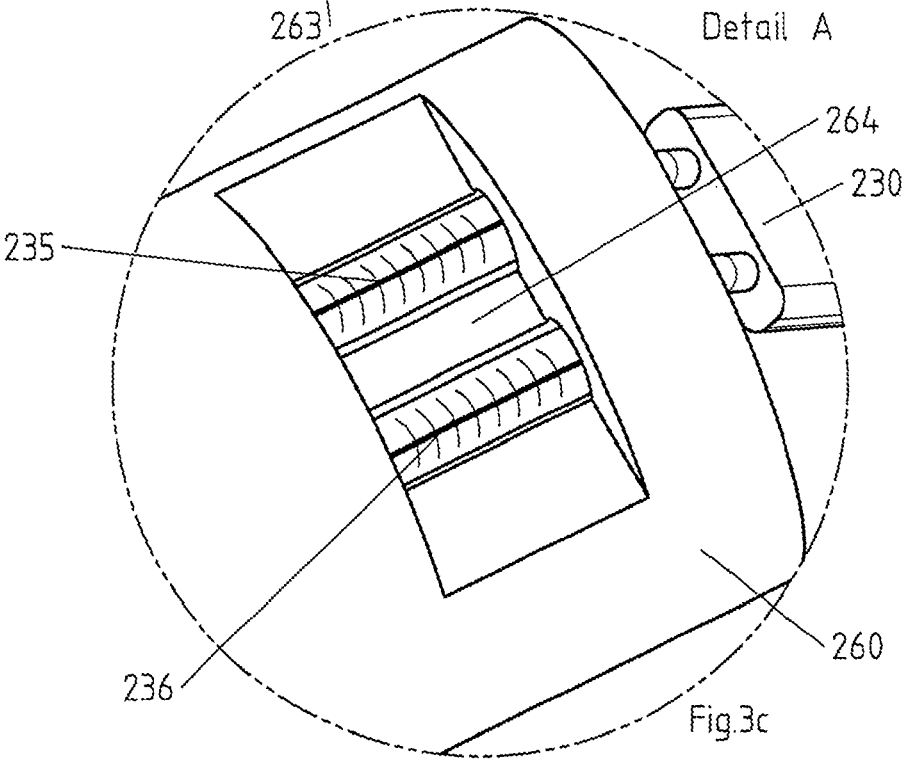
FIG. 3*c*: a cut-out enlargement from Detail A of FIG. 3*b;*

The variant of the heating cartridge 200 shown in FIGS. 3*a* to 3*c* differs only with respect to a modified insulating element 260 that is used instead of the insulating element 240, which is why otherwise the same reference symbols are being used. In addition to the holes 261, 262, 263, which are arranged exactly as in the insulating element 240, the insulating element 260 also has a window 264 that locally exposes the supply lines 231, 232 and connecting wires 233, 234 and therefore allows the contacting between the supply lines 231, 232 and the associated connecting wires 233, 234, as shown in FIG. 3*c* in detail by welded positions 235, 236, to be produced and verified in a defined way with reliable processing.

Figure 4A:
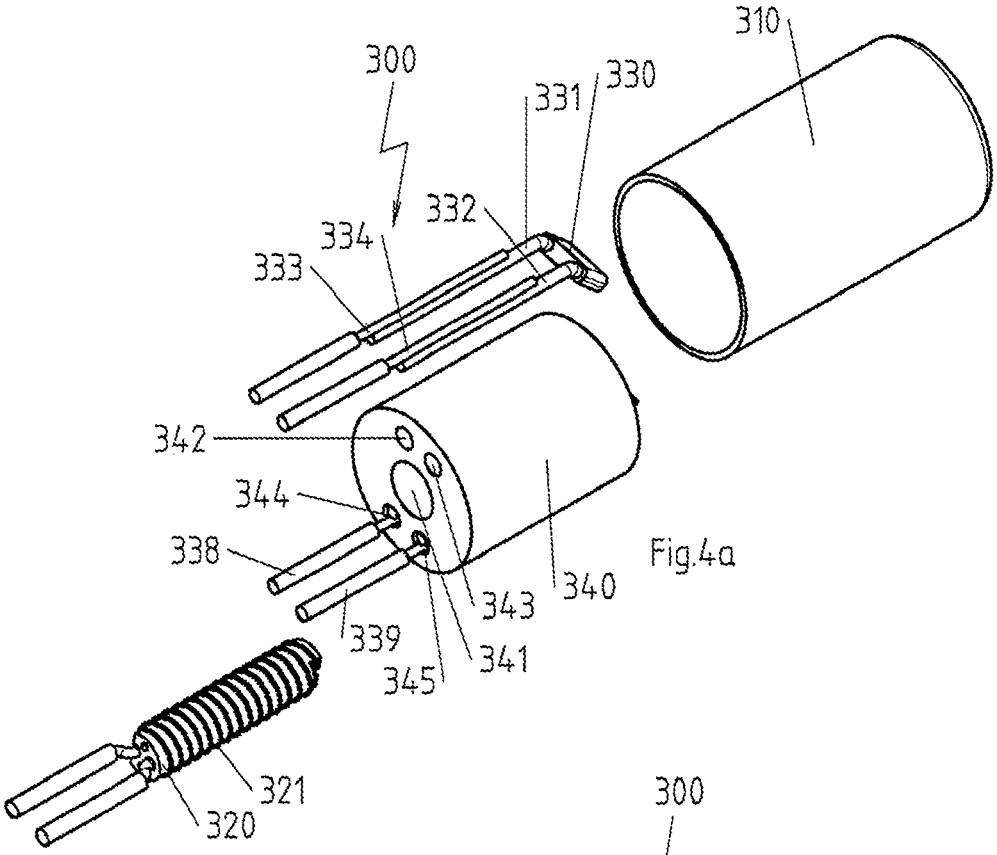
FIG. 4*a*: a partial exploded-view diagram of a third embodiment of a heating cartridge.
Figure 4B:
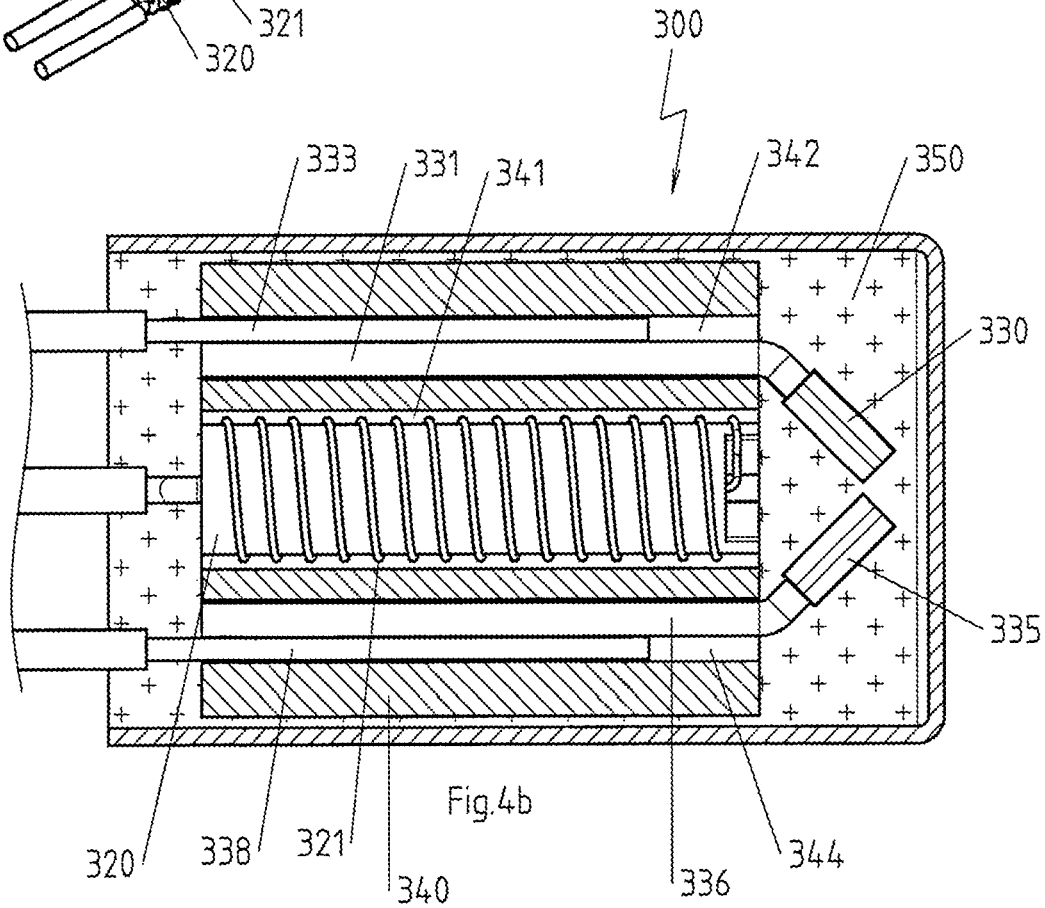
FIG. 4*b*: a section diagram of the embodiment from FIG. 4*a*.

The embodiment shown in FIGS. 4*a* and 4*b* is a heating cartridge 300 with tubular metal sheathing 310 with base 311 that can be seen in FIG. 4*b*, winding form 320 with heating element 321 wound thereon in the form of a heating wire, temperature sensor 330 with supply lines 331, 332 and connecting wires 333, 334, as well as an insulating element 340 with holes 341, 342, 343, which is constructed as a ceramic molded body.

The difference with respect to the embodiment of FIGS. 2*a* and 2*b* consists in that a second temperature sensor 335 with supply lines 336, 337 and connecting wires 338, 339 is provided and in that, in the insulating element 340, two additional holes 344, 345 are arranged, in which the supply lines 336, 337 are brought into contact with and pressed with the connecting wires 338, 339.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A heating cartridge comprising:

a tubular metal sheathing having an interior an electrical heating element housed in the interior, the electrical heating element wound on a winding form and being electrically insulated from the tubular metal sheathing by embedding in an electrically non-conductive insulating material; and at least one temperature sensor with supply lines, wherein at least one of the supply lines runs between the winding form and the tubular metal sheathing and is electrically insulated from the winding form, the heating element, and the tubular metal sheathing, wherein the winding form and the at least one supply line are held in recesses of an insulating element.

2. The heating cartridge according to claim 1, wherein the recesses run parallel to an axis of the tubular metal sheathing.

3. The heating cartridge according to claim 2, wherein, in the recesses in which the supply lines are arranged, an electrical connection to connecting wires inserted into the recesses is created.

4. The heating cartridge according to claim 3, wherein the insulating element has at least one window that exposes the supply lines and connecting wires at locations at which electrical connections are created.

5. The heating cartridge according to claim 1, wherein the heating cartridge is compacted.

6. The heating cartridge according to claim 1, wherein the insulating element is a ceramic molded body.

7. The heating cartridge according to claim 1, wherein spaces remaining between the electrical heating element and the insulating element and between the tubular metal sheathing and the insulating element are filled at least partially with the insulating material, the insulating material comprised of MgO granulate.

8. The heating cartridge according to claim 1, wherein the supply lines lie in a plane in which the winding form also lies and are arranged on different sides of the winding form.

9. The heating cartridge according to claim 1, wherein the at least one temperature sensor is comprised of two temperature sensors including a first temperature sensor and a second temperature sensor, wherein the first temperature sensor includes first supply lines, the first supply lines lie above a plane in which the winding form lies, and the second temperature sensor includes second supply lines, the second supply lines lie below the plan.

10. The heating cartridge according to claim 1, further having connecting wires for contacting the supply lines and wherein the supply lines and the connecting wires are inserted from different sides into the insulating element.

11. The heating cartridge according to claim 10, wherein a press-fit contact is created between the connecting wires and the supply lines and the electrical heating element.

12. The heating cartridge according to claim 1, wherein the recesses are filled with MgO powder or granulate, the MgO powder or granulate comprising the insulating material.

13. A heating cartridge comprising:

a tubular metal sheathing having an interior;

an electrical heating element housed in the interior, the electrical heating element wound on a winding form and being electrically insulated from the tubular metal sheathing by embedding in an electrically non-conductive insulating material;

at least one temperature sensor with supply lines, wherein at least one of the supply lines runs between the winding form and the tubular metal sheathing and is electrically insulated from the winding form, the heating element, and the tubular metal sheathing; and at least three connecting wires for contacting the supply lines and contacting the electrical heating element, wherein at least one of the at least three connecting wires runs at least in some sections through the winding form and wherein at least two of the at least three connecting wires run outside of the winding form.

14. The heating cartridge according to claim 13, wherein the at least one of the three connecting wires for contacting the electrical heating element runs through the winding form and the at least two of the at least three connecting wires for contacting the supply lines of the temperature sensor run outside of the winding form at least partially within an insulating element.

* * * * *